United States Patent [19]

Sander et al.

[11] 4,112,029

[45] Sep. 5, 1978

[54] MANUFACTURE OF FIBRIDS OF POLYOLEFINS

[75] Inventors: Bruno Sander, Ludwigshafen; Eckhard Bonitz, Frankenthal; Kurt Scherling, Hemsbach, all of Fed. Rep. of Germany

[73] Assignee: BASF Aktiengesellschaft, Ludwigshafen am Rhein, Fed. Rep. of Germany

[21] Appl. No.: 532,589

[22] Filed: Dec. 13, 1974

[30] Foreign Application Priority Data

Dec. 21, 1973 [DE] Fed. Rep. of Germany ..... 2363671

[51] Int. Cl.[2] ..... B01J 2/06

[52] U.S. Cl. ..... 264/11; 264/12; 264/13

[58] Field of Search ..... 264/5, 13, 14, 11, 12

[56] References Cited

U.S. PATENT DOCUMENTS

| | | | |
|---|---|---|---|
| 3,042,970 | 7/1962 | Terenzi | 264/14 |
| 3,081,519 | 3/1963 | Blades et al. | 264/5 |
| 3,287,301 | 11/1966 | Fysh et al. | 260/23.7 |
| 3,342,921 | 9/1967 | Brundige et al. | 264/14 |
| 3,461,193 | 8/1969 | Gilardi | 264/85 |

FOREIGN PATENT DOCUMENTS 1,124,578 7/1968 United Kingdom.

OTHER PUBLICATIONS

Sander et al., Manufacture of Fibrids of Polyolefins U.S. Application S.N. 532,193, filed Dec. 12, 1974.

*Primary Examiner*—Robert F. White
*Assistant Examiner*—James R. Hall
*Attorney, Agent, or Firm*—Keil, Thompson & Shurtleff

[57] ABSTRACT

Fibrids of polyolefins showing a high degree of fibrillation and a high specific surface area are obtained by flashing a pressurized solution or polyolefin in pentane or in a pentane-containing solvent by passing said solution through an orifice into a space which is at a lower pressure and in which shearing forces are applied to said solution. The fibrids directly obtained may be used, for example, for the manufacture of paper or for the manufacture of textile-like webs.

5 Claims, No Drawings

MANUFACTURE OF FIBRIDS OF POLYOLEFINS

This application discloses and claims subject matter described in German patent application No. 23 63 671.7, filed Dec. 21, 1973, which is incorporated herein by reference.

This invention relates to a process for the manufacture of fibrids of polyolefins by dissolving a polyolefin in an organic solvent under pressure and at a temperature which at standard pressure is above the boiling point of the solvent, and flashing the solution by passing it through an orifice into a space which is at a lower pressure and in which shear forces are applied to the solution.

Fibrids of polyethylene are produced, for example, by dissolving polyethylene in an organic solvent at an elevated temperature under pressure and then flashing the solution through a nozzle. The primary products are coherent masses of fibers or plexus filaments (German published application No. 1,290,040) or fibrous gels (German published applications Nos. 2,117,370; 2,227,021 and 2,237,606).

In order to obtain fibrids from the plexus filaments or the coherent masses, it is first necessary to cut these into staple lengths and then to disentangle them in liquids by the action of high shearing forces to obtain discrete fibrids. The fibrids liberated in this manner are relatively short and show only a low degree of fibrillation.

The fibrous gels contain a high proportion of solvent and turn into hard crumbly masses, no longer of a fibrous nature, when left in the air. The fibrous gels shrink and stick together when left in the air.

However, discrete fibrids may be obtained from the fibrous gels if the solvent-containing gel is subjected to the action of mechanical shearing forces in a liquid medium. The liquid medium consists of solvent and/or dispersion-containing water.

On removal of the liquid medium, the residual solvent and/or water is removed from the disentangled fibrids by evaporation or by steam distillation. However, this must be effected in the presence of surfactants such as polyhydroxyl compounds (German published application No. 2,237,606) and, possibly, anti-foaming agents, as the heat treatment will otherwise cause the fibrids to agglomerate and lose their fibrous character. The solvent-free fibrids contain a high proportion of auxiliaries and therefore have only restricted application. For example, when sheets of paper are prepared from polyolefin fibrids obtained in this manner, fiber bondingand the initial wet strength of the sheets are impaired by the presence of surfactants and anti-foaming agents.

In another well-known process, the solvent residues are removed by solvent exchange. In this method, the solvents, primarily cyclohexane and n-hexane, are replaced, in a first extraction stage, by some other solvent, such as isopropanol, which is then washed out in a second extraction stage by means of water. This method is expensive and time-consuming.

The fibrids obtained by the prior art processes cannot be disentangled, for example with the aid of an opener, willey, card or spiked rollers.

It is an object of the invention to modify the process described above in such a manner that the drawbacks of the prior art processes are obviated. It is desired to produce, directly, fibrids which are morphologically similar to cellulose fibers. This means that they should have a high degree of fibrillation, should have a high specific surface area, should not agglomerate on evaporation of the solvent, should not (substantially) shrink when left in the air and should be capable of being isolated in the absenee of auxiliaries.

The object is achieved, according to the invention, by using, as solvent, pentane or a solvent mixture containing at least sufficient pentane to cause the polyolefin to separate in the form of discrete fibrids when the solution is relaxed. Unlike the prior art processes, this method produces individual fibrillated fibrids. They are produced as a tangled mass. Surprisingly, the polyolefin fibrids of the invention do not agglomerate when, for example, dried at an elevated temperature or when the residual solvent is distilled off from an aqueous fiber suspension.

The immediate product is a fiber which is no longer swollen by solvent. No fibrous gel is formed.

By polyolefins, we mean for example partially crystalline polymers, particularly polymers of olefins of from 2 to 8 carbon atoms. Suitable partially crystalline olefin polymers have an X-ray crystallinity of more than 5% w/w at a temperature of 25° C. We prefer to use polyethylenes having densities of from 0.915 to 0.965 g/cm$^3$ and polypropylene. The molecular weight of the polyethylenes is characterized by their melt index, the maximum molecular weight being indicated by a melt index of 0.01 g/10 min (as measured at a temperature of 190° C and a load of 21.6 kg), and the minimum molecular weight being indicated by a melt index of 100 g/10 min (190° C/2.16 kg). The melt index is determined by the method laid down in ASTM D 1238-65T. The polyethylenes are produced by the well-known high-pressure and low-pressure polymerization processes. They are commercially available, as is polypropylene, the molecular weight of which is characterized by an intrinsic viscosity of, preferably, from 1.5 to 8 dl/g (as measured in decalin at 130° C).

Also suitable are copolymers of ethylene with other ethylenically unsaturated compounds, for example copolymers of ethylene and propylene, copolymers of ethylene and butylene, copolymers of ethylene and 4-methylpentene-1 and copolymers of ethylene and vinyl esters derived, for example, from saturated carboxylic acids of from 2 to 4 carbon atoms, copolymers of ethylene and acrylates of from 1 to 3 carbon atoms, copolymers of ethylene and methacrylates of from 1 to 8 carbon atoms, copolymers of ethylene and fumaric acids, maleic acid, itaconic acid and their esters, and copolymers containing polymerized units of acrylic acid and methacrylic acid. Particularly significant are copolymers of ethylene and vinyl acetate, copolymers of ethylene and n-, iso- or tert.-butylacrylate, copolymers of ethylene and acrylic acid and copolymers containing polymerized units of 2 or more of said ethylenically unsaturated comonomers, for example comonomers of ethylene, acrylic acid and vinyl acetate and comonomers of ethylene, acrylic acid and tert.-butyl acrylate. It is, of course, also possible to produce fibrids from mixtures of various polymers, for example from a blend of high-pressure and low-pressure polyethylenes at a ratio of 1:1 or a blend of 80% of high-pressure polyethylene and 20% w/w of an ethylene-vinyl acetate copolymer having a vinyl acetate content of 15% by weight. Usually, the ethylene copolymers contain up to 50% w/w of one or more comonomers, preferably from 5 to 40% w/w of comonomers.

In order to obtain fibrids from the polyolefins, the latter are dissolved in an organic solvent. The solubility of the polyolefins in said organic solvent is greatly dependent on the temperature. In order to obtain a highly concentrated solution, the polyolefin is preferably dissolved at a temperature which is above the boiling point of the solvent used. It is therefore necessary to produce the polyolefin solution in a pressure vessel. For example, this may be a stirred pressure tank, or the polyolefin may first be melted in a screw machine, e.g. a twin-shaft screw kneader, the molten polyolefin then being mixed with the solvent under pressure. In order to obtain fibers from the polyolefin solutions in accordance with the present invention, the concentration of the polyolefin in the solution may be from 0.5 to 30% and preferably from 10 to 25% by weight.

The polyolefin solutions are passed through a two-component nozzle to be flashed in a chamber filled, for example, with nitrogen at atmospheric pressure and maintained at from 50° to 80° C. In order to produce a field of shear forces in this chamber, a driving jet is used. This driving jet may be produced, for example, by the use of a liquid or gaseous auxiliary medium. The preferred gaseous auxiliary medium (driving jet) is nitrogen. The two-component nozzle consists, for example, of two concentric tubes. The polymer solution may be flashed through the central tube, whilst the nitrogen jet is passed through the outer annular space, or via versa. This method of flash evaporation produces non-tangled, discrete fibrids of polyolefins containing only small amounts of solvents (1 to 3% w/w). The solvent vapors are condensed and returned to the process. To remove the residual solvent, a stream of nitrogen heated at 60° C may be passed countercurrently into the flash chamber, if nitrogen has been used as the auxiliary medium. The fibrids thus obtained are virtually free from solvent.

If it is desired to produce a fiber suspension, the chamber in which flash evaporation is carried out may contain an organic solvent, the solvent mixture in which the polyolefin is dissolved or water. In this case, the liquid auxiliary medium (driving jet) used is one of the liquids mentioned, preferably the solvent mixture in which the polyolefin is dissolved. When using this method, either the two-component nozzle described above or the two-component or multi-component nozzle provided with impulse exchange chamber described in German published application No. 2,208,921 is used. (See also U.S. Pat. No. 3,755,452 for impulse exchange chamber apparatus). In a further embodiment, the field of shear forces may, of course, be produced by means of a high-speed stirrer.

Flashing is effected isothermally with evaporation cooling, excess heat being removed via a cooler. The resulting slurry of fibrids is diluted, if necessary, by the addition of the same solvent to a density at which the product can be transported hydraulically and at which fine disentanglement may be carried out for certain purposes, for example, for the formation of a sheet of paper. The fibers are then substantially freed from solvent, for example, by evaporation, filtration, centrifuging or filtering under suction or pressure, the recovered solvent being directly recycled to the process.

According to the invention, the solvent used for the polyolefins is pentane or a solvent mixture containing pentane. For the purposes of the present invention, we mean, by pentane, all isomers of pentane such as n-pentane, isopentane, cyclopentane and neopentane. Use will usually be made of an isomeric mixture, for example a mixture of n-pentane and isopentane, although pure n-pentane, isopentane or neopentane may of course be used.

Also suitable for the process of the invention are solvent mixtures containing at least sufficient pentane to cause the polyolefin to separate in the form of discrete fibrids when the homogeneous solution is flashed in a space which is at a lower temperature. Suitable solvent mixtures are obtained by adding pentane to organic solvents capable of dissolving polyolefins. Organic solvents for polyolefins are for example cyclohexane, methylcyclohexane, n-hexane, n-heptane, n-octane, isooctane and aromatic hydrocarbons such as benzene, toluene, xylene, ethylbenzene and chlorinated hydrocarbons such as methylene chloride, trichloromethane, tetrachloroethylene and chlorobenzene.

Particularly suitable solvents are naphtha cuts boiling at from 25° to 140° C. Particularly advantageous are ligroin (b.p. 30° to 60° C) and low-boiling naphtha (b.p. 55° to 95° C). Mixtures of said solvents may also be used if desired.

The amount of pentane required in the solvent mixture is dependent on the molecular weight and molecular weight distribution of the polyolefin used, on the solvent action of the solvent used and on the processing conditions. The required amount of pentane in the solvent mixture may be readily determined, for each polyolefin, by simple tests in which, for example, polyethylene is dissolved, with heating, in various cyclohexane-pentane mixtures and observations are made to discover the mixtures from which the polyethylene no longer separates in a gelled condition. Suitable solvent-pentane mixtures may contain for example up to 98% by weight of pentane.

We prefer to use naphtha cuts as organic solvents, these containing from 5 to 50% and preferably from 10 to 30% by weight of pentane. In order to obtain maximum concentrations of polyolefin in the solution, those solvents are added to pentane which are very good solvents for the polyolefins.

According to the invention, the polyolefin solutions are generally prepared in such proportions that the vapor pressure above the mixture is from about 4 to 60 and preferably from 10 to 20 atmospheres at temperatures at from 80° to 250° C and preferably from 100° to 180° C. However, the solution may be prepared at lower temperatures and/or under inert gas pressure, for example nitrogen pressure of up to 60 atmospheres.

The homogeneous polyolefin solutions are then passed through an orifice, e.g. a nozzle or a tube, to be flashed in a chamber which is at a lower pressure and in which a field of shear forces is produced. The pressure in this chamber may be atmospheric or above or below atmospheric.

Alternatively, the homogeneous solution may be flashed under the action of a field of shear forces in a container filled with a precipitating medium, for example the same solvent or solvent mixture in which the polyolefin is dissolved. The chamber in which flashing of the homogeneous solution is carried out under shear may, if desired, contain water or an organic liquid which is a non-solvent for the polyolefin used. Examples of non-solvents (precipitating agents) are naphtha cuts, pentane, water, acetone, methylethylketone, methanol, isopropanol and n-hexanol. The orifice through which the homogeneous solution is flashed may have any desired geometrical shape. Preferably, it is of circular cross-section having a diameter of up to about 20 mm and preferably from 3 to 10 mm.

If the homogeneous solution is flashed, for example, in a space filled with one of the above liquids acting as precipitant, a constant level of liquid may be maintained above the outlet of the tube through which the solution is passed. Flashing of the pressurized polymer solution is preferably carried out isothermally with evaporative cooling, the excess heat being removed by means of a cooler. The resulting slurry of fibrids is adjusted, if necessary, to a different density, for example, one at which the product may be hydraulically transported, by the addition of further amounts of the solvent in which the polymer is dissolved.

In another embodiment of the process of the invention, the polyolefin solution is flashed by passage into a cylindrical chamber either tangentially or centrally thereto. This chamber is at the top of a vertical tube, down which the fibrids fall when the solvent has evaporated. The solvent vapors released by the flash are condensed by cooling. The fibrids formed by the flash are dried by means of warm nitrogen which is passed countercurrently through the tube arrangement. Virtually solvent-free polyolefin fibrids are discharged at the bottom of the tube.

If, in the process of the invention, a slurry of fibrids is obtained, the fibrids are substantially separated from the solvent for example by evaporation, filtration, centrifuging and suction or pressure filtering. The solvent may be immediately re-used.

The fibrids show high values of specific surface area, these being from about 10 to 50 $m^2/g$ (as measured by the BET-method by nitrogen adsorption. The lengths of the fibrids are generally from 1 to 40 mm and their thickness is between 2 and 30 $\mu m$.

The main advantage of the process of the invention is that it is no longer necessary to disentangle the coherent mass of fibrids or a gel by mechanical means. It is thus no longer necessary to add dispersing or stabilizing auxiliaries or an additional solvent for solvent exchange in order to obtain discrete solvent-free fibrids. Another advantage of the process of the invention is that the fibrids may be further processed immediately or once they have been treated with an agent suitable for the purpose in hand.

The tangled mass of polyolefin fibrids of the invention may be used, for example, for the manufacture of paper or textile-like webs. To manufacture paper, the fibrids are suspended in, say, water and the aqueous suspension is processed in a paper machine to form sheets of paper. Sheets of paper may alternatively be prepared from mixtures of the polyolefin fibrids and cellulose fibrids. The two types of fibers may be blended in any desired proportions. For the preparation of the aqueous suspensions of polyolefin fibrids, dispersing agents are used in amounts of up to 2% by weight, based on the dry weight of the polyolefin fibrids. Suitable dispersing agents are for example melamine-formaldehyde polycondensates prepared by polycondensation of melamine, formaldehyde and aminocarboxylic acids or alkali metal salts thereof in aqueous solution. Another suitable dispersing agent is an anionic protective colloid, which is also used in amounts of up to 2% by weight, based on the dry weight of the polyolefin fibrids. Suitable anionic protective colloids are for example condensates of formaldehyde and the sodium salt of $\beta$-naphthalene sulfonic acid, polycondensates of urea, formaldeyde and the sodium salt of phenol sulfonic acid, urea-formaldehyde polycondensates which have been modified with sodium bisulfate or melamine-formaldehyde polycondensates which have been modified with sodium hydrogen sulfite, alkali metal salts of carboxymethyl cellulose, copolymers of maleic acid and vinyl isobutyl ether and ammonium salts of copolymers of styrene and acrylic acid.

Paper webs produced with the polyolefin fibrids of the invention are distinguished by good fiber bonding and high dry and wet strength. The high degree of fibrillation of the fibrids may be determined, for example, by assessing the freeness by the Schopper-Riegler method (Korn/Burgstaller, "Handbuch der Werkstoffprüfung", 2nd edition, 1953, Vol. 4, "Papier- and Zellstoffprüfung", pp. 388 et seq., published by Springer-Verlag). To carry out this test, the fibrids must be treated with dispersing agents and converted to an aqueous suspension of constant density (2 g/l at 20° C). That amount of water is determined which is retained by the suspended fibrids under specific conditions. The retained amount of water (° Schopper-Riegler, ° SR) is greater, the higher the degree of fibrillation of the fibrids. For example, the Schopper-Riegler values of fibrids of linear polyethylene of the invention are from 15 to 30° SR.

The invention is further described with reference to the following Examples, in which the parts are by weight.

EXAMPLE 1

In a pressure vessel provided with a stirrer, 14 parts of a linear polyethylene having a density of 0.96 $g/cm^3$, a melt index of 4.5 g/10 min (190° C./2.16 kg) and a melting point of 130° C. are dissolved in a mixture of 51.6 parts of low-boiling naphtha (b.p. 65° to 95° C.) and 34.4 parts of pentane consisting of 80 parts of n-pentane and 20 parts of isopentane, at 165° C. The pressure rises to 18 to 20 atmospheres gage. This solution is passed through a two-component nozzle downwardly and centrally into a filter tube of Perlon having a mesh width of 0.5 mm, the diameter of the filter tube being 2 mm and its length 6 m. This filter tube is suspended in a chamber filled with nitrogen at atmospheric pressure and held at a temperature of 40° C. The two-component nozzle consists of two concentric tubes, the inner tube having an outer diameter of 6 mm and an internal diameter of 4 mm. The outer tube surrounds the inner tube and forms an annular space having a width of 0.75 mm and through which nitrogen is flashed as it passes from a storage tank in which the pressure is 20 atmospheres gage. The fibrous product is continuously discharged at the bottom of the filter tube. The solvent vapors entrained by the nitrogen are condensed by cooling and recycled to the process. The nitrogen is compressed and returned to the storage tank, from which it again passes to the two-component nozzle.

The fibrous product obtained has a bulk density of 10 g/l. It is virtually free from solvent. The fibrids have a length of from 0.5 to 20 mm and a diameter of from 3 to 30/$\mu m$ and their degree of fibrillation is similar to that of slightly milled cellulose fibers. The Schopper-Riegler value is found to be 20° SR.

EXAMPLE 2

Example 1 is repeated, a polyethylene solution being produced in the same example mixture at 165° C., the proportions being 10 parts of the same polyethylene to 90 parts of the solvent mixture. This solution is flashed by passage through the same two-component nozzle as that described in Example 1, the polyethylene solution passing through the annular space of the nozzle. The liquid passing through the central tube, which has an internal diameter of 4 mm, is the same naphtha mixture as that used for the production of the solution. In all, 98 parts of the naphtha mixture are used for every 2 parts of polyethylene.

The two-component nozzle ends tangentially in a cylindrical chamber having a diameter of 1 m and a height of 0.5 m, this being filled with the same solvent mixture as that in which the polymer was dissolved. The nozzle orifice is below the surface of the liquid. The excess heat is removed partly by the addition of the cold solvent mixture and partly by evaporative cooling. The reflux temperature is 45° to 55° C. The fibrid slurry is continuously discharged through an overflow from the cylindrical flash chamber. The fibrid suspension may, for example, be directly spread out to form a sheet on an endless screen having a mesh width of 0.2 mm. Removal of the residual adhering solvent is effected by storing the web in a tnak through which nitrogen flows at room temperature.

Alternatively, the fibrids may be isolated from the suspension by filtration and drying to give fine fibrids having a length of from 0.3 to 10 mm and a diameter of from 1 to 20 μm.

EXAMPLE 3

Example 2 is repeated, a polyethylene solution being produced in the same solvent mixture and containing 97 parts of solvent mixture for every three parts of polyethylene. This solution is flashed by passage through a two-component nozzle having an impulse exchange chamber as described in German published application No. 2,208,921. After filtration and drying, there is obtained a fibrous product which is finer and shorter than that obtained in Example 2. The fibrid lengths range from 0.1 to 5 mm and the diameters from 0.5 to 1 μm.

EXAMPLE 4

Polyethylene is produced in a polymerization plant by the high-pressure process to give a product having a density of 0.918 g/cm$^3$ and a melt index of 1.5 g/10 min (190° C./2.16 kg). The product is molten and is blended, at a temperature of 145° C. in a twin-shaft worm kneader, with pentane consisting of 80 parts of n-pentane and 20 parts of isopentane, to give a 25% w/w solution. The pressure at the head of the extruder is 20 to 25 atmospheres gage. This solution is then passed through a two-component nozzle consisting of two concentric tubes to pass centrally into a vertical cylinder having a diameter of 3 m and a length of 8 m. The inner tube of the two-component nozzle, through which the polymer solution flows, has an internal diameter of 4 mm and a length of 30 cm and is directly connected to the extruder by a pipeline having an internal diameter of 10 mm and a length of 2 m. The concentric outer tube of the two-component nozzle surrounds the inner tube of the nozzle to give a 0.5 mm wide annular space through which nitrogen flows, this coming from a storage tank which is under a pressure of 20 atmospheres gage. The fibers are discharged at the bottom of the cylindrical flash chamber. The temperature in this chamber is 50° C. The solvent vapors entrained by the nitrogen are condensed by cooling and recycled to the process. The nitrogen is compressed and returned to the two-component nozzle via the storage tank. The resulting fibrous product consists of entangled discrete fibrids having a length of from 0.5 to 15 mm and a diameter of from 1 to 10 μm. The Schopper-Riegler value is found to be 22° SR. This is equivalent to the degree of fibrillation of a slightly milled cellulose fiber.

We claim:

1. A process for the manufacture of discrete, non-agglomerated fibrids of an olefin polymer having at 25° C. an X-ray crystallinity of more than 5% w/w, said fibrids having a high degree of fibrillation and a high specific surface area, not agglomerating on evaporation of solvent therefrom, having substantially no shrink when left in air, and capable of being isolated in the absence of auxiliaries, which process comprises (a) forming a solution in a pressure vessel by dissolving 0.5 to 30% w/w of said olefin polymer in a solvent which is pentane or a solvent mixture containing at least sufficient pentane to cause the polyolefin to separate in the form of discrete fibrids when said solution is relaxed, said mixture containing up to 98% pentane, under pressure at a temperature of 100° to 180° C., (b) passing a stream of said solution at a pressure thereof of 4 to 60 atmospheres gauge and at a temperature of 100° to 180° C. through an orifice of up to 20 mm diameter into a chamber which is at atmospheric pressure and has a temperature of 50 to 80° C., said chamber containing a body of the same liquid solvent but which is non-solvent for said olefin polymer at 50°–80° C., and said stream is passed into said body of liquid beneath the surface of said liquid, (c) passing a liquid coaxially with said stream into said chamber to produce a field of shear forces in said chamber, (d) flashing off in said chamber essentially all of said solvent from said stream and thereby solidifying said olefin polymer, and simultaneously forming in said field of shear forces discrete fibrids of said olefin polymer having lengths of 1 to 40 mm and thicknesses between 2 and 30 μm, and (e) removing from said chamber a mass of said discrete, non-agglomerated fibrids.

2. A process as claimed in claim 1 wherein the diameter of said orifice is in the range of 3 to 10 mm.

3. A process for the manufacture of discrete, non-agglomerated fibrids of an olefin polymer having at 25° C. an X-ray crystallinity of more than 5% w/w, said fibrids having a high degree of fibrillation and a high specific surface area, not agglomerating on evaporation of solvent therefrom, having substantially no shrink when left in air, and capable of being isolated in the absence of auxiliaries, which process comprises (a) forming a solution in a pressure vessel by dissolving 0.5 to 30% w/w of said olefin polymer in a solvent which is pentane or a solvent mixture containing at least sufficient pentane to cause the polyolefin to separate in the form of discrete fibrids when said solution is relaxed, said mixture containing up to 98% pentane, under pressure at a temperature of 100° to 180° C., (b) passing a stream of the resultant solution at a pressure thereof of 4 to 60 atmospheres gauge and at a temperature of 100° to 180° C. through an orifice of up to 20 mm diameter into a chamber filled with nitrogen at atmospheric pressure and having a temperature of 50° to 80° C., (c) passing a nitrogen jet coaxially with said stream into said chamber to produce a field of shear forces in said chamber, (d) flashing off in said chamber essentially all of said solvent from said stream and thereby solidifying said olefin polymer, and simultneously forming in said field of shear forces discrete fibrids of said olefin polymer having lengths of 1 to 40 mm and thicknesses between 2 and 30 $\mu$m, and (e) removing from said chamber a mass of said discrete, non-agglomerated fibrids.

4. A process as claimed in claim 3 wherein the diameter of said orifice is in the range of 3 to 10 mm.

5. A process as claimed in claim 1 wherein said solvent mixture is a commercial naphtha cut containing pentane in an amount of 5 to 50% by weight.

* * * * *